United States Patent [19]

Duhaime et al.

[11] Patent Number: 4,651,135

[45] Date of Patent: Mar. 17, 1987

[54] MAIL DETECTOR

[76] Inventors: Paul T. Duhaime; George Spector, both of 233 Broadway, RM 3615, New York, N.Y. 10007

[21] Appl. No.: 585,220

[22] Filed: Mar. 1, 1984

[51] Int. Cl.[4] ..... G08B 13/14

[52] U.S. Cl. ..... 340/569; 200/61.63; 232/34

[58] Field of Search ..... 340/569, 568, 570; 232/35, 34, 36, 17; 200/61.63

[56] References Cited

U.S. PATENT DOCUMENTS

| | | | |
|---|---|---|---|
| 713,662 | 11/1902 | Miesse | 340/569 X |
| 1,131,211 | 3/1915 | Collier | 340/549 X |
| 1,758,546 | 5/1930 | Wartmann | 340/568 |
| 2,835,887 | 5/1958 | Seeley et al. | 340/569 |
| 2,958,858 | 11/1960 | Eversole | 340/569 X |
| 2,968,804 | 1/1961 | Buffington | 340/569 |

FOREIGN PATENT DOCUMENTS

| | | | |
|---|---|---|---|
| 805872 | 12/1936 | France | 340/569 |

OTHER PUBLICATIONS

*Signal Wiring,* by T. Croft, 1st ed., 1926, McGraw-Hill.

*Primary Examiner*—James L. Rowland
*Assistant Examiner*—Jeffery A. Hofsass

[57] ABSTRACT

A mail detector is provided and consists of a mail box having a hinged door to provide access to the mail box for inserting mail, means for detecting mail within the mail box, a remote power source, a remote switch for connecting the power source through the means for detecting mail within the mail box when the switch is closed, a remote indicator lamp connected between the power source and the switch, the remote indicator lamp energized when the switch is closed and by the means for detecting mail within the mail box so that a person can look at the energized remote indicator lamp and know that mail is in the mail box and a mail box indicator lamp connected between the means for detecting mail within the mail box and the switch, the mail box indicator lamp energized when the switch is closed and by the means for detecting mail within the mail box so that a person can look at the energized mail box indicator lamp and know that mail is in the mail box.

2 Claims, 3 Drawing Figures

MAIL DETECTOR

BACKGROUND OF THE INVENTION

The instant invention relates generally to mail boxes and more specifically it relates to a mail detector.

It is time consuming to wait for mail to be delivered to ones mail box. A person must go outside, open the door of the mail box and look inside. In rain or snow it can become a nuisance to check the mail box many times. This situation is not desirable so accordingly it is in need of an improvement.

SUMMARY OF THE INVENTION

A principle object of the present invention is to provide a mail detector that will indicate at the mail box and inside the dwelling that mail has been delivered.

Another object is to provide a mail detector that will indicate at the mail box that mail has not been delivered.

An additional object is to provide a mail detector that can be activated by either a photoelectric apparatus or by the weight of the mail itself.

A further object is to provide a mail detector that is simple and easy to use.

A still further object is to provide a mail detector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
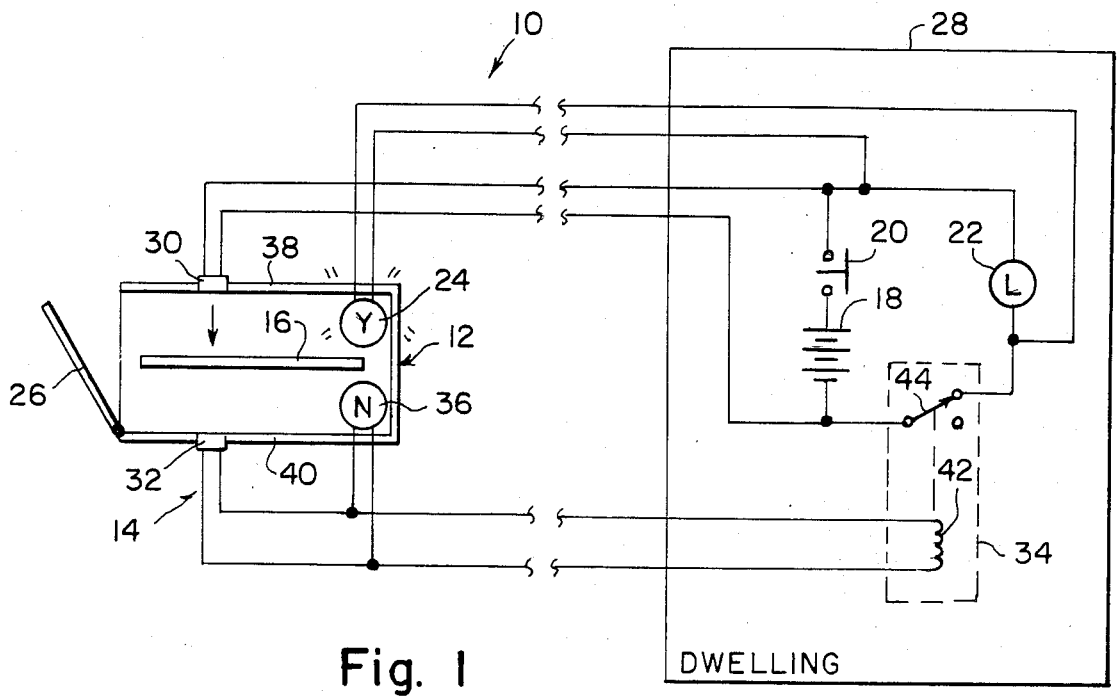
FIG. 1 is a schematic diagram of the invention.

Turning now descriptively to the drawings, in which similar reference characters denote similar elements throughout the several views, FIG. 1 illustrates a mail detector 10. The detector 10 basically consists of a mail box 12, means 14 for detecting mail 16 within the mail box 12, a remote power source 18, a remote switch 20, a remote indicator lamp 22 and a mail box indicator lamp 24.

The mail box 12 has a hinged door 26 to provide access to the mail box 12 for inserting mail 16. The remote power source 18 is a battery placed somewhere within a dwelling 28. The remote switch 20 is for connecting the power source 18 through the means 14 for detecting mail 16 within the mail box 12 when the switch 20 is closed.

The remote indicator lamp 22 is connected between the power source 18 and the switch 20. The remote indicator lamp 22 is energized when the switch 20 is closed and by the means 14 for detecting mail 16 within the mail box 12. A person can look at the energized remote indicator lamp 22 and know that mail 16 is in the mail box 12.

The mail box indicator lamp 24 is connected between the means 14 for detecting mail 16 within the mail box 12 and the switch 20. The mail box indicator lamp 24 is energized when the switch 20 is closed and by the means 14 for detecting mail 16 within the mail box 12. A person can look at the energized mail box indicator lamp 24 and know that mail 16 is in the mail box 12.

The means 14 for detecting mail 16 within the mail box 12 basically consists of a light source 30, a photoelectric cell 32, a relay 34 and a relay indicator lamp 36.

The light source 30 is affixed to top wall 38 of the mail box 12. When the light source 30 is energized by the battery 18, a beam of light will pass from the top wall 38 of the mail box 12 to a bottom wall 40 of the mail box 12, unless the beam is interrupted by mail 16 placed within the mail box 12.

The photoelectric cell 32 is affixed to the bottom wall 40 of the mail box 12 to receive the beam of light and provide a control signal in the absence of mail 16 within the mail box 12.

The relay 34 is connected to the photoelectric cell 32, the remote indicator lamp 22 and the mail box indicator lamp 24. The relay 34 is responsive to the control signal from the photoelectric cell 32. The remote indicator lamp 22 and the mail box indicator lamp 24 is energized if mail 16 is in the mail box 12 and is deenergized if mail 16 is not in the mail box 12.

The relay indicator lamp 36 is connected between the photoelectric cell 32 and the relay 34. The relay indicator lamp 36 is energized when the photoelectric cell 32 receives the beam of light and provides a control signal in the absence of mail 16 within the mail box 12. A person can look at the energized relay indicator lamp 36 and know that mail 16 is not in the mail box 12.

The relay 34 consists of a relay coil 42 and a relay arm 44. The relay coil 42 is activated by the control signal. The relay arm 44 is in a normally closed position between the battery 18, remote indicator lamp 22 and mail box indicator lamp 24. Energizing of the relay coil 42 will move the relay arm 44 to an open position disconnecting the remote indicator lamp 22 and the mail box indicator lamp 24.

Figure 2:
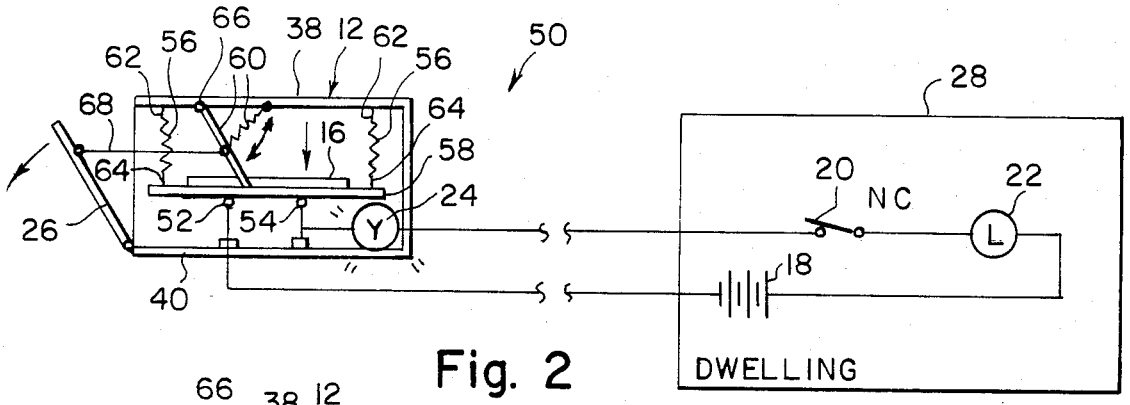
FIG. 2 is a schematic diagram of a modified form of the invention showing the circuit activated.
Figure 3:
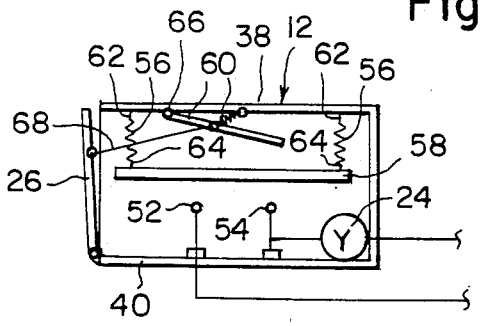
FIG. 3 is a schematic diagram of part of FIG. 2 showing the circuit deactivated.

FIGS. 2 and 3 illustrates another type of mail detector 50. This detector basically consists of a pair of contacts 52 and 54, a plurality of springs 56, an electrically conductive platform 58 and a spring loaded lever 60.

The pair of contacts 52 and 54 are spaced apart and affixed to inner surface of bottom wall 40 of the mail box 12. Contact 54 is electrically connected to the mail box indicator lamp 24 while the other contact 52 is electrically connected to the battery 18 placed somewhere within the dwelling 28.

Each spring 56 is connected at one end 62 to inner surface of the top wall 38 of the mail box 62 so that the springs 56 will hang downwardly. The platform 58 is affixed to other end 64 of each of the springs 56. When mail 16 is placed onto the platform 58 the weight of the mail 16 will make the platform travel downwards engaging the pair of contacts 52 and 54 to close the circuit as shown in FIG. 2.

The spring loaded lever 60 is pivotable at 66 to the inner surface of the top wall 38 of the mail box and mechanically connected at 68 to the hinged door 26 of the mail box 12. When the door 26 is opened for inserting mail 16, the lever 60 will push against the platform 58. The platform 58 will travel downwards engaging the pair of contacts 52 and 54 to close the circuit. A person will know immediately that mail 16 is going to be inserted into the mail box 12.

FIG. 3 shows the circuit deactivated. The door 26 is closed with the lever 60 in a retracted position. There is no mail 16 in the mail box 12 so that the springs 56 keep the platform 58 up away from the contacts 52 and 54 and the mail box indicator lamp 24 is not energized.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A mail detector comprising:

(a) a mail box having a door for access thereto;

(b) means for detecting mail in the box;

(c) a remote power source;

(d) a remote switch for connecting said power source with said means;

(e) a remote indicator in series with said switch;

(f) a second indicator mounted on the mail box in series with said switch wherein said means for detecting mail within the box comprises a normally open switch responsive to the opening of said door and placement of mail in said box to close said switch whereby both said indicators will indicate the presence of mail in said box, wherein said normally open switch comprises:

(a) a pair of spaced contacts in series with the remote indicator;

(b) a platform with an electrically conductive bottom surface responsive to placement of mail therein to move downward to cause said surface to engage said contacts;

(c) spring means biasing said platform away from said contacts to the open switch position;

(d) means for closing said normally open switch, secured to the box and said door whereby door opening movement causes downward platform movement to close said switch.

2. A mail detector as in claim 1, wherein the last said means comprises a lever spring biased away from said platform responsive to door opening to engage and move said platform to engage said contacts.

* * * * *